US010506900B1

(12) United States Patent
Pagliaro et al.

(10) Patent No.: US 10,506,900 B1
(45) Date of Patent: Dec. 17, 2019

(54) PAPER TOWEL ROLL HOLDER

(71) Applicants: Michael Pagliaro, Johnston, RI (US); Dana Pagliaro, Johnston, RI (US)

(72) Inventors: Michael Pagliaro, Johnston, RI (US); Dana Pagliaro, Johnston, RI (US)

( * ) Notice: Subject to any disclaimer, the term of this patent is extended or adjusted under 35 U.S.C. 154(b) by 310 days.

(21) Appl. No.: 15/584,214

(22) Filed: May 2, 2017

(51) Int. Cl.

| | |
|---|---|
| ***A47K 10/22*** | (2006.01) |
| ***A47K 10/40*** | (2006.01) |
| ***A47K 10/32*** | (2006.01) |
| ***A45B 25/00*** | (2006.01) |
| ***A47K 10/16*** | (2006.01) |
| ***A47K 10/38*** | (2006.01) |
| ***B65H 75/00*** | (2006.01) |

(52) U.S. Cl.
CPC ..... *A47K 10/22* (2013.01); *A47K 10/32* (2013.01); *A47K 10/405* (2013.01); *A45B 2025/003* (2013.01); *A47K 10/16* (2013.01); *A47K 10/3827* (2013.01); *A47K 10/40* (2013.01); *A47K 2010/3233* (2013.01); *A47K 2010/389* (2013.01); *B65H 75/00* (2013.01)

(58) Field of Classification Search
CPC .... A47K 10/22; A47K 10/24; A47K 10/1016; A47K 10/18; A47K 2010/3233; A47K 10/405; A47K 10/38; A47K 10/32; A47K 2010/389; A47K 2010/3827; A47K 10/40; A47K 2201/00; A47K 10/16; A47K 10/3827; F16G 11/00; F16B 2/00; F16B 2/02; A45B 9/00; A45B 2009/002; A45B 2025/003
USPC ..... 242/597.7; 248/226.11, 227.3, 228.1
See application file for complete search history.

(56) References Cited

U.S. PATENT DOCUMENTS

| | | | | |
|---|---|---|---|---|
| 2,339,926 | A * | 1/1944 | Hays | G03D 13/145 242/129.51 |
| 3,721,395 | A * | 3/1973 | Snipes | A47K 10/38 242/134 |
| 5,297,749 | A * | 3/1994 | White | A47K 10/3836 242/597.4 |
| D453,263 | S | 2/2002 | Wogan | |
| 6,443,172 | B2 | 9/2002 | Brumfield | |
| 7,334,593 | B2 | 2/2008 | Avery | |
| 7,789,459 | B1 | 9/2010 | Rodriguez | |
| 8,640,894 | B1 | 2/2014 | Cronin | |
| 2006/0011787 | A1 | 1/2006 | Law | |
| 2014/0332618 | A1 | 11/2014 | McNicholas | |
| 2017/0135534 | A1* | 5/2017 | Shaw | A47K 10/405 |
| 2017/0156457 | A1* | 6/2017 | Wilcox | A47K 10/38 |
| 2017/0159878 | A1* | 6/2017 | Lewis | A47K 10/22 |
| 2017/0240343 | A1* | 8/2017 | Kryscio | A47K 10/3827 |
| 2017/0273516 | A1* | 9/2017 | McNicholas | A47K 10/22 |

FOREIGN PATENT DOCUMENTS

| | | | |
|---|---|---|---|
| WO | 2012146300 | A1 | 11/2012 |

* cited by examiner

*Primary Examiner* — William E Dondero
*Assistant Examiner* — Raveen J Dias

(57) ABSTRACT

The paper towel roll holder attaches to the pole of a patio umbrella and holds a roll of paper towels off of the surface of the patio table.

16 Claims, 5 Drawing Sheets

PAPER TOWEL ROLL HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of patio furniture, more specifically, a paper towel caddy that attaches to a patio umbrella.

Paper towels are often needed outside while dining at a patio table. Because patio tables are generally smaller than tables used indoors, it is advantageous to keep the roll of paper towels off the surface of the patio table but still in close proximity to where they are needed.

SUMMARY OF INVENTION

The paper towel roll holder attaches to the pole of a patio umbrella and holds a roll of paper towels off of the surface of the patio table.

An object of the invention is to provide access to a roll of paper towels near a patio table that is equipped with a patio umbrella.

A further object of the invention is to hold the roll of paper towels elevated above the surface of the patio table to free up space on the patio table for other uses.

These together with additional objects, features and advantages of the paper towel roll holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the paper towel roll holder in detail, it is to be understood that the paper towel roll holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the paper towel roll holder.

It is therefore important that the claims be regarded as including such equivalent construction insofar as they do not depart from the spirit and scope of the paper towel roll holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
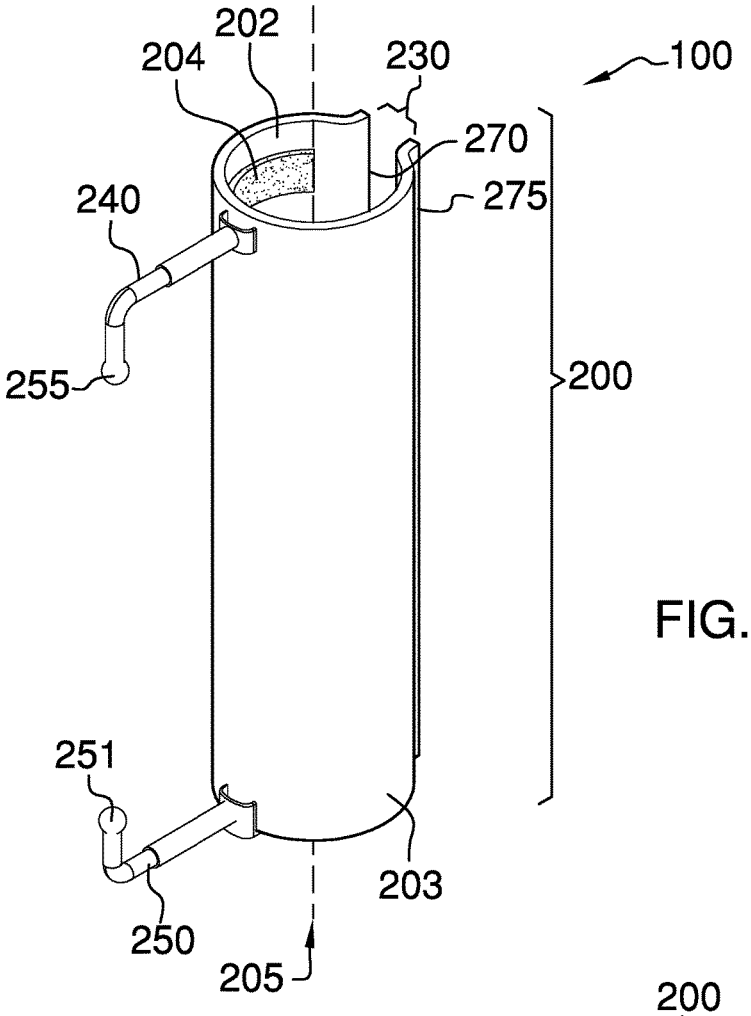
FIG. 1 is a perspective view of an embodiment of the disclosure.
Figure 2:
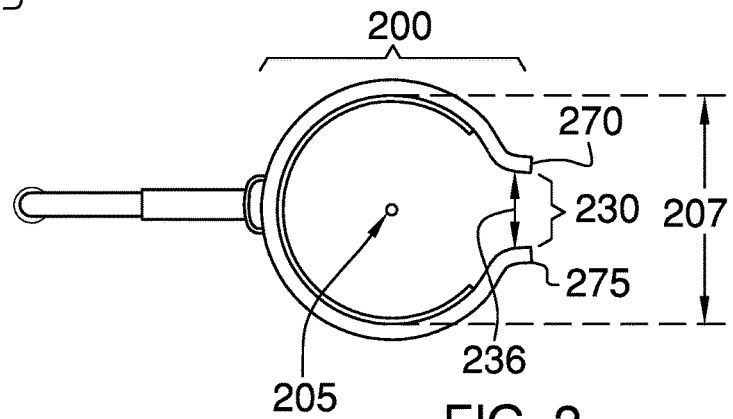
FIG. 2 is a top view of an embodiment of the disclosure.
Figure 3:
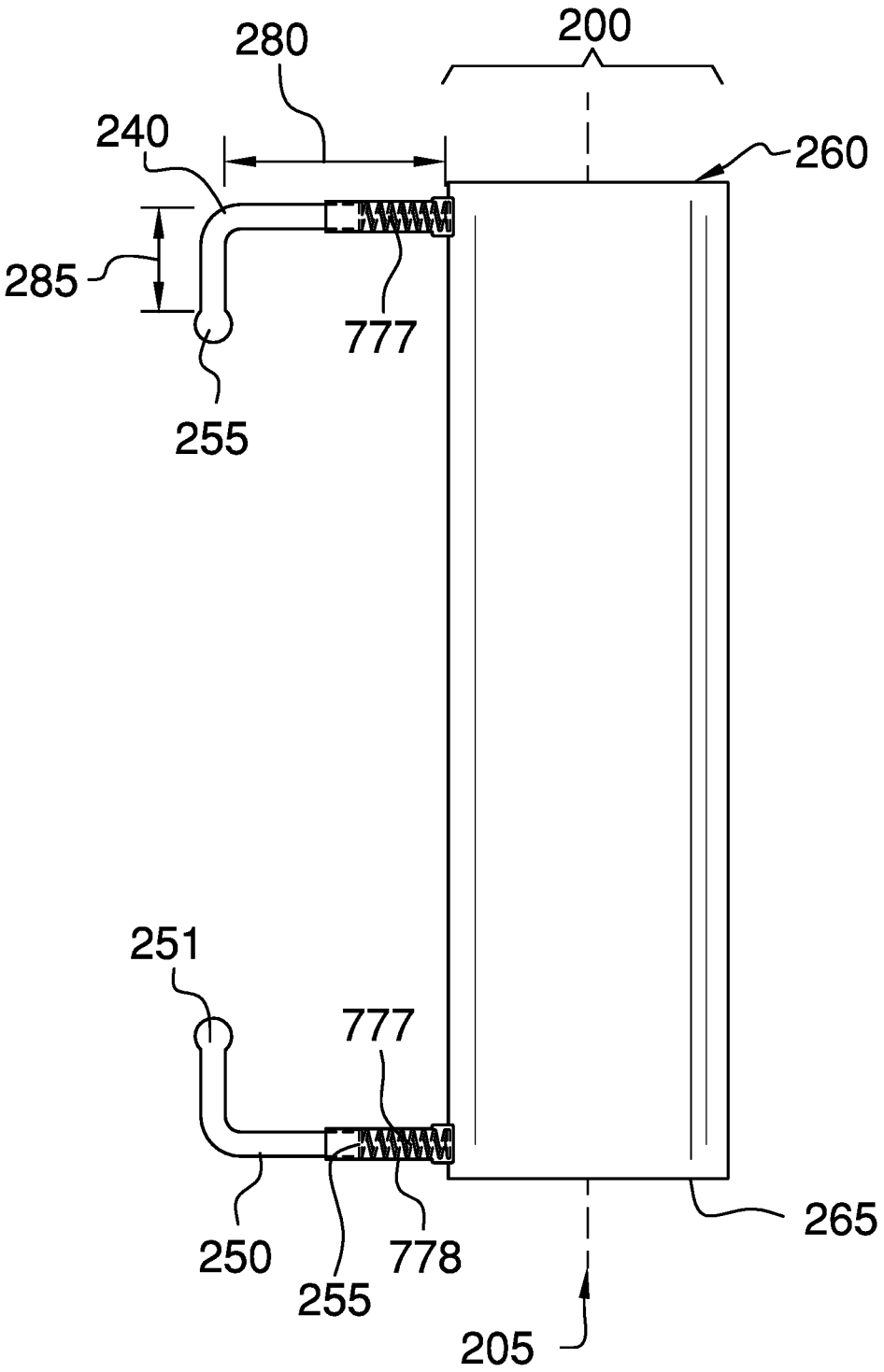
FIG. 3 is a side view of an embodiment of the disclosure.
Figure 4:
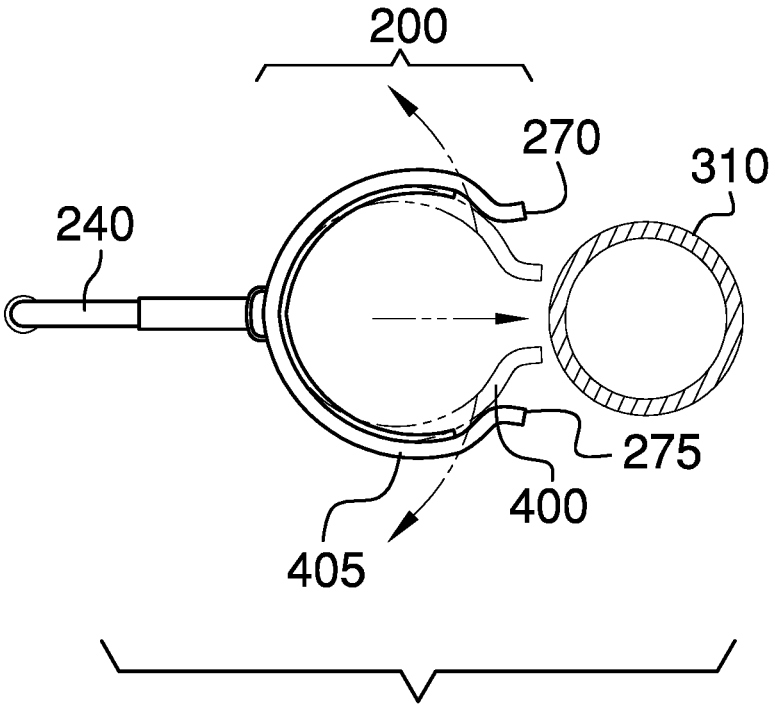
FIG. 4 is a top view of an embodiment of the disclosure illustrating installation of the invention onto an umbrella pole.
Figure 5:
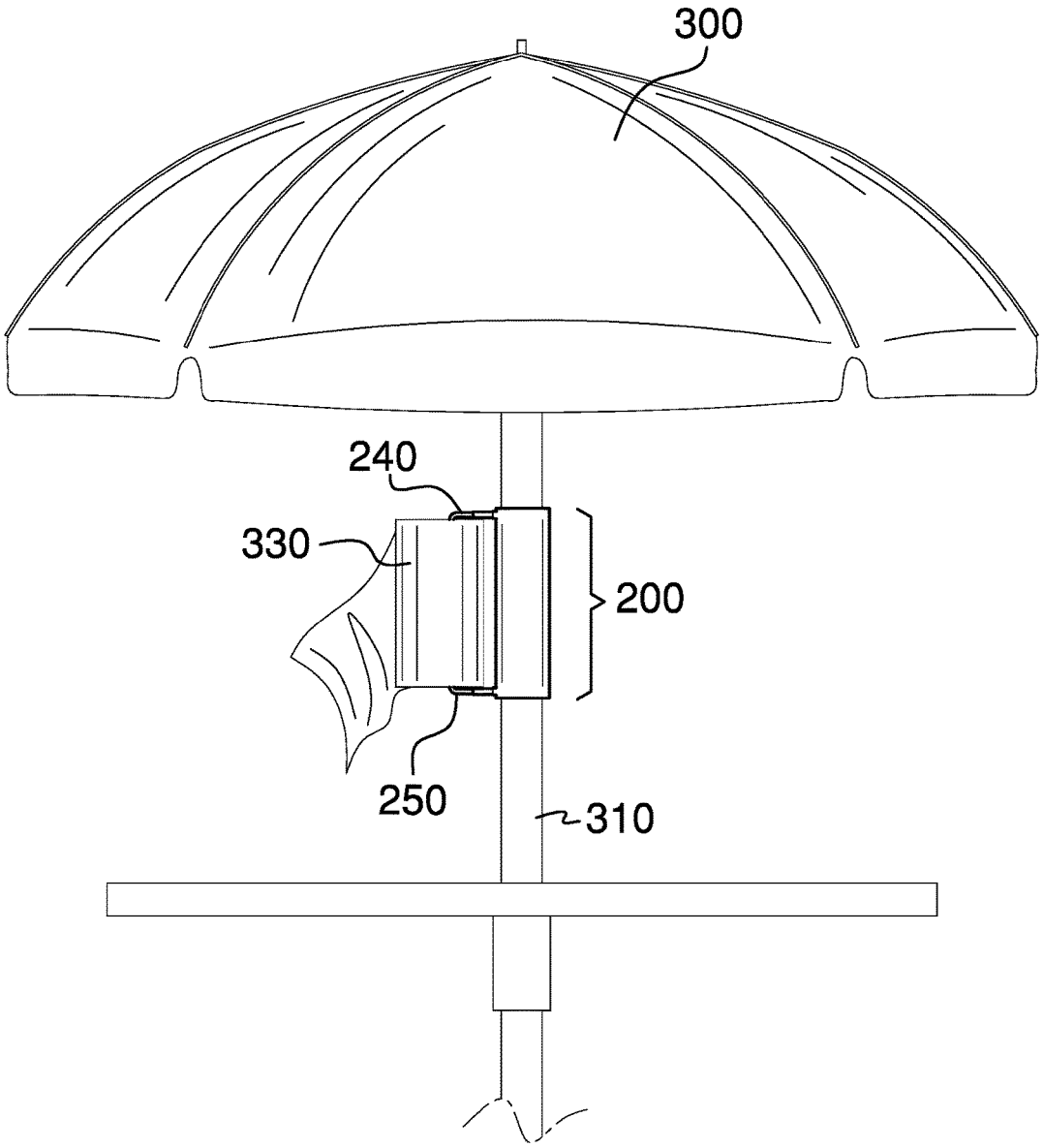
FIG. 5 is a side view of an embodiment of the disclosure illustrating the invention in use.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6.

The paper towel roll holder 100 (hereinafter invention) comprises a clamp 200, an upper arm 240, and a lower arm 250. The clamp 200 is cylindrical in nature and is oriented vertically, defining a top 260 and a bottom 265. A gap 230 runs longitudinally from the top 260 to the bottom 265 defining a first edge 270 of the clamp 200 and a second edge 275 of the clamp 200. The gap 230 has a width 236 which is measured from the first edge 270 to the second edge 275 and which is generally between ⅓ and 1/10 of the circumference of the clamp 200. The gap 230 allows the clamp 200 to be installed onto a pole 310 of a patio umbrella 300 in such a way that the clamp 200 almost entirely encircles the pole 310. The diameter 207 of the clamp 200 is therefore selected to be approximately the same as the diameter of the pole 310 of a patio umbrella 300 of average size.

Figure 6:
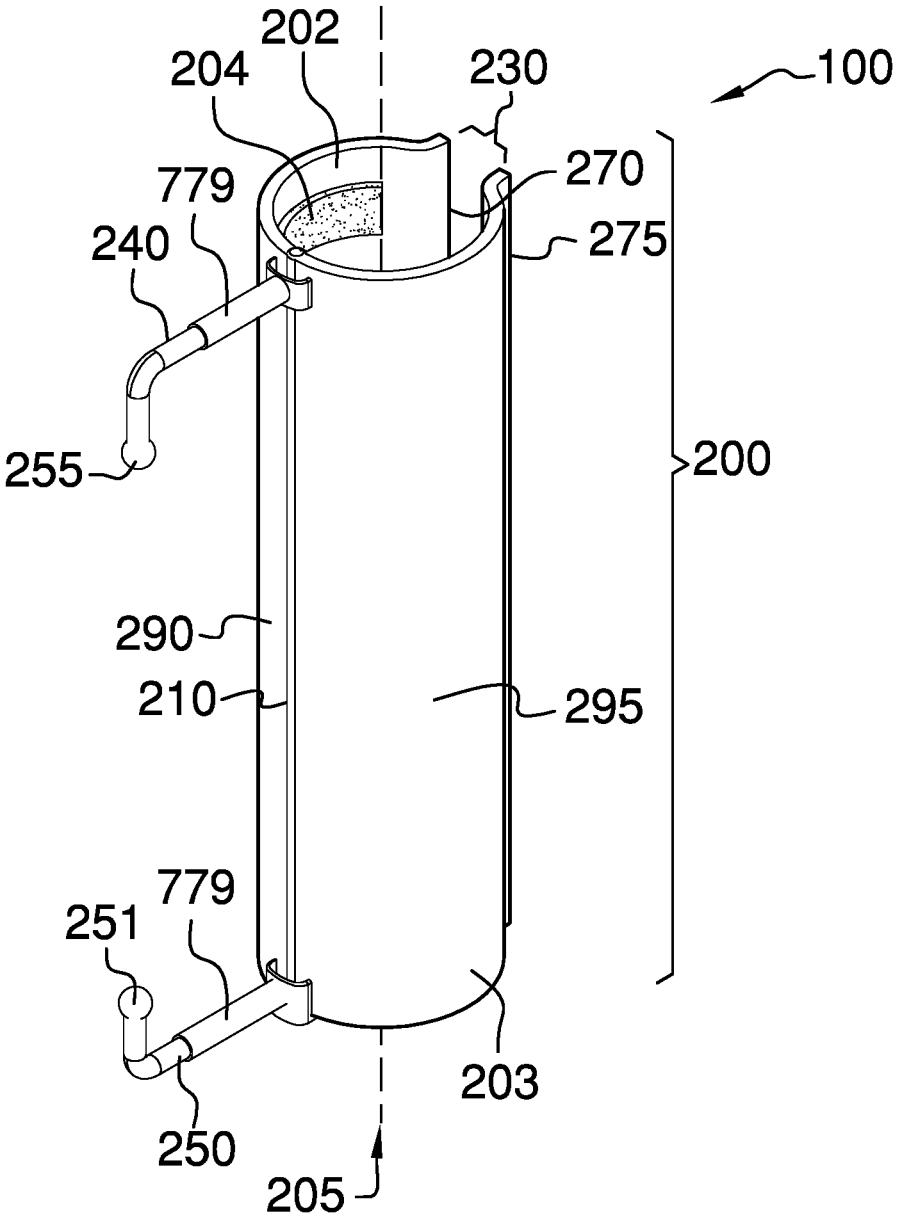
FIG. 6 is a perspective view of an embodiment of the disclosure.

In some embodiments, the clamp 200 may be fabricated from a single piece of material, generally a flexible plastic (See FIG. 6). In these embodiments, the flexible nature of the material allows the gap 230 to widen as the clamp 200 is pushed onto the pole 310. The gap 230 then springs back to its original dimensions once the clamp 200 has encircled the pole 310.

In some embodiments, the clamp 200 may be fabricated from multiple parts (See FIG. 1). In these embodiments the clamp 200 may comprise a left half clamp 290, a right half clamp 295, and a hinge 210. The hinge 210 runs longitudinally from the top 260 to the bottom 265 along a line that is directly opposite the gap 230. The hinge 210 hingedly joins the left half clamp 290 and the right half clamp 295. When pressure is exerted against the hinge 210 by manipulating the first edge 270 and the second edge 275 of the clamp 200, the first edge 270 and the second edge 275 move outward—away from a center 205 of the clamp 200—resulting in the clamp 200 becoming a deformed cylinder 405 and allowing the gap 230 to widen. This allows the clamp 200 to be pushed onto the pole 310. Once in place, the hinge 210 returns to its default position where it holds the left half clamp 290 and the right half clamp 295 in the shape of a non-deformed cylinder 400 thus restoring the gap 230 to its original size. It shall be noted that the hinge 210 is spring-loaded, which is well known in the art, and which enables the clamp 200 to return to its default position.

In some embodiments, the clamp 200 is held in place by friction between the pole 310 and an inside surface 202 of the clamp 200. In some embodiments, the paper towel roll holder 100 may comprise one or more enhanced friction surfaces 204 on the inside surface 202 of the clamp 200 to provide a stronger grasp of the clamp 200 onto the pole 310, and to prevent the clamp 200 from sliding down the pole 310. As a non-limiting example, the one or more enhanced friction surfaces 204 may comprise a roughened area on the inside surface 202 of the clamp 200 or a friction material applied to the inside surface 202 of the clamp 200. A non-limiting example of a friction material includes friction tape.

In some embodiments, the first edge 270 of the clamp 200 may bend outward from the center 205 of the clamp 200 forming a first flared clamp edge 350 and the second edge 275 of the clamp 200 may bend outward from the center 205 of the clamp 200 forming a second flared clamp edge 355. The first flared clamp edge 350 and the second flared clamp edge 355 make it easier to install the paper towel roll holder 100 onto the pole 310 because they provide a grasping edge and they guide the first edge 270 and the second edge 275 away from each other as the paper towel roll holder 100 is installed onto the pole 310.

The upper arm 240 is an L-shaped, flexible member. One end of the upper arm 240 attaches to an outside surface 203 of the clamp 200 near the top 260 of the clamp 200 and at a point directly opposite the gap 230. The upper arm 240 extends in a direction away from the center 205 of the clamp 200 for a first distance 280 before turning and extending downwards for a second distance 285. The first distance 280 is calculated to be ½ of the diameter of a roll of paper towels 330 plus an additional distance to provide space between the roll of paper towels 330 and the pole 310. The second distance 285 is calculated to be long enough to extend into the hollow core (not shown in the figures) of the roll of paper towels 330 but short enough to allow the upper arm 240 to be flexed up far enough to allow removal and insertion of the roll of paper towels 330 onto the paper towel roll holder 100.

The lower arm 250 is an L-shaped, flexible member. One end of the lower arm 250 attaches to the outside surface of the clamp 200 near the bottom 265 of the clamp 200 and at a point directly opposite the gap 230. The lower arm 250 extends in a direction away from the center 205 of the clamp 200 for the first distance 280 before turning and extending upwards for the second distance 285. The first distance 280 is calculated to be ½ of the diameter of the roll of paper towels 330 plus an additional distance to provide space between the roll of paper towels 330 and the pole 310. The second distance 285 is calculated to be long enough to extend into the hollow core (not shown in the figures) of the roll of paper towels 330 but short enough to allow the lower arm 250 to be flexed down far enough to allow removal and insertion of the roll of paper towels 330 onto the paper towel roll holder 100.

The upper arm 240 may terminate at the end that is not attached to the clamp 200 with an upper finial 255. The lower arm 250 may terminate at the end that is not attached to the clamp 200 with a lower finial 257. The upper finial 255 and the lower finial 257 may enhance the appearance of the paper towel roll holder 100 and may help to prevent injuries that might otherwise result from being poked by a narrow end of the upper arm 240 or the lower arm 250.

In some embodiments, the upper arm 240 and the lower arm 250 may telescope with respect to the clamp 200. The ability of the upper arm 240 and the lower arm 250 to telescope with respect to the clamp 200 enables the first distance 280 to change. The ability of the first distance 280 to change is in direct correlation with the size of the roll of paper towels 330. As the roll of paper towels 330 is consumed, the first distance 280 would reduce because the roll of paper towels 330 is becoming smaller. In this scenario, both the upper arm 240 and the lower arm 250 include a spring 777 that imposes a biasing force that pulls the upper arm 240 and the lower arm 250 inwardly towards the clamp 200. Moreover, both the upper arm 240 and the lower arm 250 each include an arm armature 778, which is rigidly affixed to the clamp 200. The arm armature 778 is of tubular construction and houses the spring 777 within. Moreover, a distal end 779 of the upper arm 240 and the lower arm 250 is affixed to the spring 777 such that the upper arm 240 and the lower arm 250 are each able to telescope within the respective arm armature 778.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A paper towel roll holder comprising:

a clamp, an upper arm, and a lower arm;

wherein the clamp is cylindrical and is oriented vertically, defining a top and a bottom of the clamp;

wherein a gap runs longitudinally from the top to the bottom defining a first edge of the clamp and a second edge of the clamp;

wherein a diameter of the clamp is approximately the same as a diameter of a pole of a patio umbrella;

wherein the clamp is held in place by friction between the pole and an inside surface of the clamp;

wherein the gap has a width which is measured from the first edge to the second edge;

wherein the width is between ⅓ and 1/10 of a circumference of the clamp;

wherein the upper arm is an L-shaped, flexible member;

wherein one end of the upper arm attaches to an outside surface of the clamp near the top of the clamp and at a point directly opposite the gap;

wherein the upper arm extends in a direction away from a center of the clamp for a first distance before turning and extending downwards for a second distance.

2. The paper towel roll holder according to claim 1 wherein the clamp is fabricated from multiple parts compromising a left half clamp, a right half clamp, and a hinge;

wherein the hinge runs longitudinally from the top to the bottom along a line that is directly opposite the gap.

3. The paper towel roll holder according to claim 2 wherein the hinge hingedly joins the left half clamp and the right half clamp;

wherein a default position of the hinge holds the left half clamp and the right half clamp in a shape of a non-deformed cylinder;

wherein the hinge is spring-loaded so as to enable return of the clamp to said default position;

wherein pressure exerted against the hinge by manipulating the first edge and the second edge of the clamp cause the first edge and the second edge to move outward, away from a center of the clamp, resulting in the clamp becoming a deformed cylinder and allowing the gap to widen.

4. The paper towel roll holder according to claim 3 wherein after the clamp is pushed onto the pole, the hinge returns to a default position where it holds the left half clamp and the right half clamp in the shape of the non-deformed cylinder.

5. The paper towel roll holder according to claim 1 wherein the paper towel roll holder comprises one or more enhanced friction surfaces on an inside surface of the clamp to provide a stronger grasp of the clamp onto the pole and to prevent the clamp from sliding down the pole.

6. The paper towel roll holder according to claim 5 wherein a one or more enhanced friction areas comprises a roughened area on the inside surface of the clamp.

7. The paper towel roll holder according to claim 5 wherein a one or more enhanced friction areas comprises a friction material applied to the inside surface of the clamp.

8. The paper towel roll holder according to claim 1 wherein the first edge of the clamp bends outward from a center of the clamp forming a first flared clamp edge;

wherein the first flared clamp edge makes it easier to install the paper towel roll holder onto the pole.

9. The paper towel roll holder according to claim 8 wherein the second edge of the clamp bends outward from the center of the clamp forming a second flared clamp edge;

wherein the second flared clamp edge makes it easier to install the paper towel roll holder onto the pole.

10. The paper towel roll holder according to claim 9 wherein the first distance is calculated to be no less than ½ of the diameter of a roll of paper towels.

11. The paper towel roll holder according to claim 10 wherein the second distance of the upper arm enables the upper arm to extend into a hollow core of the roll of paper towels while enabling the upper arm to be flexed up far enough to allow removal and insertion of the roll of paper towels onto the paper towel roll holder.

12. The paper towel roll holder according to claim 11 wherein the lower arm is an L-shaped, flexible member;

wherein one end of the lower arm attaches to the outside surface of the clamp adjacent the bottom of the clamp and at a point directly opposite the gap;

wherein the lower arm extends in a direction away from the center of the clamp for the first distance before turning and extending upwards for the second distance.

13. The paper towel roll holder according to claim 12 wherein the upper arm terminates at an end that is not attached to the clamp with an upper finial.

14. The paper towel roll holder according to claim 13 wherein the lower arm terminates at an end that is not attached to the clamp with a lower finial.

15. The paper towel roll holder according to claim 14 wherein the upper arm and the lower arm each telescope with respect to the clamp;

wherein the upper arm and the lower arm telescope with respect to the clamp to enable the first distance to change;

wherein the ability of the first distance to change is in direct correlation with the size of the roll of paper towels;

wherein as the roll of paper towels is consumed, the first distance reduces because the roll of paper towels is becoming smaller.

16. The paper towel roll holder according to claim 15 wherein both the upper arm and the lower arm each include a spring that imposes a biasing force that pulls the upper arm and the lower arm inwardly towards the clamp;

wherein both the upper arm and the lower arm each include an arm member, which is rigidly affixed to the clamp;

wherein the arm member is of tubular construction and houses the spring within;

wherein a distal end of the upper arm and the lower arm is affixed to the spring such that the upper arm and the lower arm are each able to telescope within the respective arm member.

* * * * *